US008090123B2

(12) United States Patent
Chen

(10) Patent No.: US 8,090,123 B2
(45) Date of Patent: Jan. 3, 2012

(54) MICROPHONE

(75) Inventor: Hsuan-Yung Chen, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 1298 days.

(21) Appl. No.: 11/723,379

(22) Filed: Mar. 19, 2007

(65) Prior Publication Data

US 2008/0107288 A1 May 8, 2008

(30) Foreign Application Priority Data

Nov. 3, 2006 (TW) ..... 95140841 A

(51) Int. Cl.
*H04R 3/00* (2006.01)
*H04R 9/08* (2006.01)

(52) U.S. Cl. ..... 381/113; 381/365

(58) Field of Classification Search ..... 381/111, 381/112, 113, 174, 355, 365; 455/569.1, 455/570, 573

See application file for complete search history.

(56) References Cited

U.S. PATENT DOCUMENTS

| | | | | |
|---|---|---|---|---|
| 5,097,515 | A * | 3/1992 | Baba | 381/191 |
| 6,978,029 | B1 * | 12/2005 | Ikeda | 381/111 |
| 7,342,172 | B1 * | 3/2008 | Wang et al. | 174/36 |
| 2006/0140423 | A1 * | 6/2006 | Tanabe et al. | 381/174 |

* cited by examiner

*Primary Examiner* — Curtis Kuntz
*Assistant Examiner* — Sunita Joshi
(74) *Attorney, Agent, or Firm* — WPAT., P.C.; Justin King

(57) ABSTRACT

The present invention discloses a microphone comprising a first electrode, a second electrode, a printed circuit board and a shielding layer. The microphone is configured into a mobile communication device. The shielding layer located on the printed circuit board is disposed on the microphone. When the mobile communication device charges with an AC power supply and communicates with others simultaneously, the shielding layer can diminish the 50~60 Hz noise produced by the AC power supply. Owing to the shielding layer reduces the EMI effect; the talking quality of the mobile communication device is thereby enormously improved.

12 Claims, 2 Drawing Sheets

MICROPHONE

TECHNICAL FIELD OF THE PRESENT INVENTION

The present invention relates to a microphone, more specifically relates to a microphone in mobile communication device for reducing external electromagnetic interference.

BACKGROUND OF THE INVENTION

Traditionally, microphone transmits sound via air; therefore, the transmission is prone to be interfered by external noise which makes the sound quality declined. The traditional electret condenser microphone composes a weightless membrane and a back plate for electret charge. The components of the electret condenser microphone are very sensitive to the external noise; the input sound signal oscillates the metal plate making the distance and the capacitance between the metal plate and the back plate change. Owing to the electret condenser microphone with extremely small capacitance has a high current consumption, the output electric current from the electret condenser microphone should be amplified by dielectrode to an acceptable level to connect with an amplifier. When the microphone receives certain level of sound pressure, it generates voltage at output terminal with which to detect the dB value, and further can be used to measure the sensitivity of a microphone which is proportional to the output voltage value. Another important character of the microphone is its output impedance, which is usually divided to three groups: low impedance (50-1000 ohms), medium impedance (5000-15000 ohms), and high impedance (over 20000 ohms).

Generally speaking, a mobile communication device includes a microphone and powered by a battery. The battery can provide DC power which is more stable and causes less electromagnetic interference than AC power. When the battery of the mobile communication device is exhausted, the battery needs to be charged via an outer charger (for example, travel charger) that transforms the AC power to DC power. When the mobile communication device processes charging and communicating with others simultaneously, the low frequency (50-60 Hz) interference generated by charger would radiate to the surroundings of the mobile communication device by the power cord of the charger; therefore the microphone is easily interfered by electromagnetic wave generated by AC power and makes the user interfered by low frequency (50-60 Hz) noise.

FIG. 1 illustrates a traditional microphone, the negative terminal 12(−) and positive terminal 13(+) are attached to a microphone 6; wherein the negative terminal 12 and positive terminal 13 are made of copper foil and both terminals are for sound output; for example, the Vout shown in the FIG. 1. For the traditional microphone, the copper foil of negative terminal 12 does not shield the positive terminal 13; therefore the positive terminal 13 is easily influenced by an external electromagnetic wave. Further, the area of positive terminal 13 and the one surrounded by the copper foil of negative terminal 12 relate to the level of interference and quality of communication for a microphone.

FIG. 2 shows a traditional microphone, the signals of the negative terminal 12 and the positive terminal 13 are transmitted to an amplifier (not shown) of the mobile communication device by the first conducting wire 26 and the second conducting wire 27 respectively. In virtue of the parallel arrangement of the first conducting wire 26 and the second conducting wire 27, their large exposure area makes the electromagnetic radiating area increase, and makes the microphone more easily interfered by AC electromagnetic wave hence declines the communication quality.

In other word, if a mobile communication device connects to a power supply for transforming AC to DC, the voice output of a microphone is pretty easily interfered by the power noise (50-60 Hz) caused by AC. Therefore, to enhance the communication quality of a mobile communication device, it is necessary to solve the noise interference. Generally, the question is solved by adding an integrated element on the circuit board or improving the design of a power transformer for transforming AC to DC, but these two methods are costly, time consuming and inefficient.

Therefore, the structure of a microphone has become an important factor in affecting the noise interference to the mobile communication device. To solve the shortcoming of the traditional technique, especially utilizing traditional technique for charging a traditional mobile communication device, the present invention provides a new microphone design to effectively reduce the noise interference of a microphone.

BRIEF SUMMARY OF THE PRESENT INVENTION

To solve the question of noise interference caused by the traditional power of the microphone mentioned in the above, the present invention provides a new microphone for effectively reducing the noise interference caused by AC power and then enhance the communication quality when the mobile communication device in charging at the same time; i.e., the microphone of the mobile communication device of the present invention would not interfere by an electromagnetic wave and keep the communication quality, when a user uses the mobile phone for communication and charging the mobile phone with a mobile travel charger at the same time.

The object of the present invention is to solve the question that the microphone of a mobile communication device is easily interfered by noise interference caused by power. The present invention refines the structure of the microphone and reducing the AC electromagnetic interference by wrapping the conducting wire (for example, 50-60 Hz) and the present invention is efficient and time-saving.

The present invention provides a microphone utilizing a shielding layer surrounding the positive terminal and negative terminal to shield the electromagnetic interference from outside, and further to wrap the conductive line can also reduce the electromagnetic radiation area.

Furthermore, the present invention discloses a microphone including a first electrode, a second electrode and a shielding layer. The first electrode is arranged on the microphone and connected with a first conducting wire; a second electrode is arranged on the microphone and connected with a second conducting wire; a shielding layer is arranged on the microphone and covering the surroundings to the first electrode and the second electrode; wherein the first conducting wire connected to the first electrode is twisted wrapped with the second conducting wire connected with the second electrode to reduce the electromagnetic radiation area. The shielding layer is for shielding the electromagnetic interference from outside.

DETAILED DESCRIPTION OF THE PRESENT INVENTION

The invention will now be described in greater detail with embodiments and illustrations attached to the present invention. Nevertheless, it will be understood by those skilled in the art that the scope of the present invention should not be limited to the described preferred embodiments but define by the claims. Furthermore, the dimension of the objects in the figures isn't totally illustrated by its real dimension and the irrelevant details are also not described in detail here in avoid of blur the main aspects of the present invention.

In the following paragraph, we only take preferred embodiments as examples for illustrating the present invention; however, those skilled in the art should understand that the illustrations can be applied on the changes and modifications of the present invention.

Referring to FIG. 3, the illustrations only represents the preferred embodiments as examples for illustration of the present invention not for limiting the scope of the present invention. FIG. 3 is the circuit diagram of microphone 10; the microphone of the present invention can apply to the mobile communication devices and other electronics.

Generally, a microphone 10 comprises a capacitance 11, for example, electret capacitor 11; when receiving a sound pressure, the capacitance is changed accordingly; therefore, the input signal Vin is created between the two electrodes. For example, the electret capacitor 11 can be formed on a semiconductor base including a wiring film (as a first electrode) and electret film (as a second electrode); where an insulation layer separates these two electrodes and the electret film is oscillated in accordance with the sound pressure. An impedance conversion circuit comprises a diode D1, a diode D2, a resistance R1, and metal oxide semiconductors T1 and T2, which respectively connects to the two electrodes of the electret capacitor 11; especially, the positive and negative electrode of the diode D1 connect to the first and the second electrode of the electret capacitor 11 respectively, but the positive and negative electrodes of the diode D2 connect to the first and the second electrode of the electret capacitor 11 in reverse way. The resistance R1 connects to the two electrodes of the electret capacitor by parallel connection. The source electrode and gate electrode of the metal oxide semiconductor T1 connect to the second and first electrode of the electret capacitor II respectively. The source electrode of the metal oxide semiconductor T2 connects to the drain electrode of the metal oxide semiconductor T1. The power source of the voltage Vdd and Vref respectively connects to the drain and gate electrode of the metal oxide semiconductor T2. The back-gate electrode of the metal oxide semiconductor T1 and T2 connects to the ground level potential (GNP). The second electrode of the electret capacitor II connects to the ground level potential (GNP). Furthermore, CX is the Parasitic Capacitance between the semiconductor base and wire film, and CG is the parasitic Capacitance between the gate electrode and source electrode of the metal oxide semiconductor T1.

When the input signal Vin isn't being applied, the voltage value between the gate electrode and source electrode of the metal oxide semiconductor T1 arranged at the two ends of the diode D1, D2, and resistance R1 is 0 volt. When a sound pressure is created, the capacitance of the electret capacitor 11 is changed accordingly, and then produces the input signal Vin between the two electrodes; thereafter the voltage between the gate electrode and the source electrode of the metal oxide semiconductor T1 is changed, and the current between the drain electrode and source electrode of the metal oxide semiconductor T1 is changed accordingly. Because the metal oxide semiconductor T1 is a depletion type transistor, even the voltage between gate and source electrode is 0, the currents still flow through the drain and source electrode. Because of the variation of the electrical currents flowing through the drain and the source electrode of the metal oxide semiconductor T1, the electrical currents flow through the drain and the source electrode of the metal oxide semiconductor T2 is changed accordingly; as the result, the voltage between the gate electrode and source electrode of the metal oxide semiconductor T2 is changed subsequently. An output voltage signal Vout is produced by the potential variation of the source electrode of the metal oxide semiconductor T2. The phase of the output voltage signal Vout is opposite to the phase of the input signal Vin. When the input signal Vin lowers down, the output signals Vout increase and vice versa. For example, the output signal can be amplified by an operational amplifier to increase the amplitude of the signal.

Referring to FIG. 4, in this embodiment, a microphone comprises a printed circuit board 9, a first electrode 14, a second electrode 15 and a shielding layer 16. In the present embodiment, a first electrode 14 is arranged on the printed circuit board 9; the second electrode 15 is arranged on the printed circuit board 9; the shielding layer 16 is arranged on the printed circuit board 9 by electroplating, the shielding layer 16 covers the surroundings of the first electrode 14 and of the second electrode 15; wherein between the first electrode 14 and the second electrode 15 exists a gap 17. In the present embodiment, the first electrode 14 is the negative terminal 141(−) of the microphone and connects with the first conducting wire 22 (referring to FIG. 6); the second electrode 15 is the positive terminal 151(+), and connects with the second conducting wire 23. In the present embodiment, the negative terminal 141 and positive terminal 151 are attached to the printed circuit board 9 and are made of copper foil; the two terminals are output terminals of a sound signal, for example, it is connected to the output signal terminal Vout shown in FIG. 1.

In the present invention, the shielding layer 16 is arranged in the surrounding area of the positive terminal 151 and negative terminal 141 of the microphone. When a user uses the mobile phone for communication and charges the mobile phone with a mobile travel charger simultaneously, the shielding layer 16 of microphone is used for shielding the magnetic interference generated when the mobile phone is connected to a power converter for converting AC to DC. The shielding layer 16 is arranged in the surrounding area of the first electrode 14 and the second electrode 15 for reducing the interference of low frequency (50-60 Hz) noise to the mobile phone.

For example, the material of the shielding layer 16 comprises metal material as conductive copper foil, aluminum tape, conductive pure (red) copper/aluminum/stainless steel foil (flat piece, board) and anti-EMI (electromagnetic interference) material, as self adhesive copper/aluminum (copper/aluminum foil tape). The electromagnetic wave often propagates via radiation or conduction, when the frequency is below 10 MHz, electromagnetic wave often propagates via conduction, but the electromagnetic wave with higher frequency often propagates by radiation. In one embodiment, as the frequency of electromagnetic wave gets lower, the shielding layer should be thicker; as the frequency of electromagnetic wave gets higher, the shielding layer can be thinner.

Referring to FIG. 4, in the present embodiment, the shielding layer 16 can be adhered to the printed circuit board 9 alone or adhered to the printed circuit board 9 at the back of the microphone. The shielding layer 16 is used to enlarge the area of negative terminal 141 (or connecting the negative terminal 141 with metal plate) to make copper foil (shielding layer) of the negative terminal 141 surrounds the whole positive terminal 151 to shield the low frequency interference (50-60 Hz) generated by a charger. Referring to FIG. 4, the area of negative terminal 141 is enlarged to act as a shielding layer 16; wherein the shielding layer 16 doesn't cover the whole positive terminal 151; therefore, the area of the gap 17 between the positive terminal 151 and the negative terminal 141 is too large and the shielding effect is somewhat diminished; hence, the present embodiment can achieve the goal of refinement but not the optimum status; therefore the shielding effect is limited.

FIG. 5 illustrate another embodiment of the present invention, the electrode 14 (negative terminal) is situated on the printed circuit board 9 on the back of the microphone and the area of electrode 14 is enlarged to act as a shielding layer 16. The shielding layer 16 covers larger area; therefore, the gap 17 between the first electrode 14 (negative terminal) and the second electrode 15 (positive terminal) is diminished; that is, when the area of the shielding layer 16 is enlarged, the shielding effect is also enhanced. Therefore, in the present invention, microphone shows better shielding effect to electromagnetic wave than the traditional one and the communication quality is enhanced.

In the present invention, in addition to electroplating the shielding layer 16 to shield the low frequency interference (50-60 Hz) generated by charger, wrapping the conducting wire also can improve the quality of communication of a mobile communication device. Referring to FIG. 6, in mobile communication device, the signal from negative terminal 141 and positive terminal 151 of microphone transmits to an amplifier of the mobile communication device through the first conducting wire 22 and the second conducting wire 23. For example, the pin 1 connects to the ground and the pin 2 connects to the output terminal.

Because of the exposure of the first conducting wire 22 and the second conducting wire 23, microphone is easily interfered by AC electromagnetic wave; to reduce this interference, the first conducting wire 22 connected with the negative terminal 141 and second conducting wire 23 connected with the positive terminal 151 should be as short as possible (the distance between them is denoted as D), and is better twisted wrapped to reduce the exposed area. As a result, the interference cause by electromagnetic wave from outer space and the area of electromagnetic radiation are reduced.

Because the microphone exists intrinsic parasite capacitance, for enhancing the shielding effect, to lower the frequency interference, a shielding layer, for example, a copper foil can be arranged between the positive terminal and negative terminal to reduce the electromagnetic interference. Comparing with the communication quality of traditional microphone interfered by electromagnetic wave, the present invention can reduce the electromagnetic interference to reach high communication quality.

Although preferred embodiments of the present invention have been described, it will be understood by those skilled in the art that the present invention should not be limited to the described preferred embodiments. Rather, various changes and modifications can be made within the spirit and scope of the present invention, as defined by the following Claims.

Figure 1:
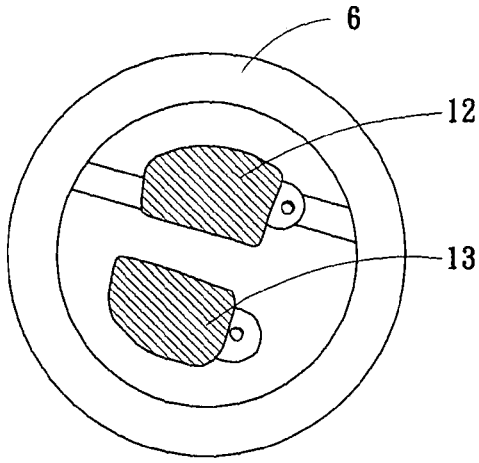
FIG.1 (prior art)
FIG. 1 illustrates a traditional microphone.
Figure 2:
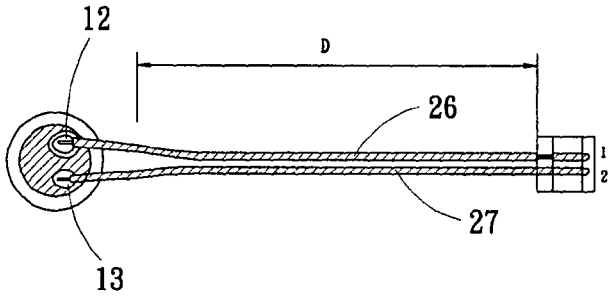
FIG.2 (prior art)
FIG. 2 illustrates an electrode terminal of a traditional microphone without shielding layer connects with an amplifier of a mobile communication device through parallel conducting wire.
Figure 3:
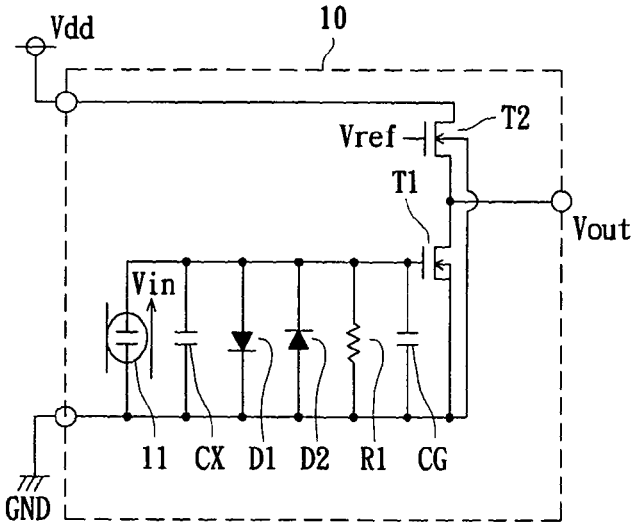
FIG. 3 illustrates a circuit diagram for a microphone.
Figure 4:
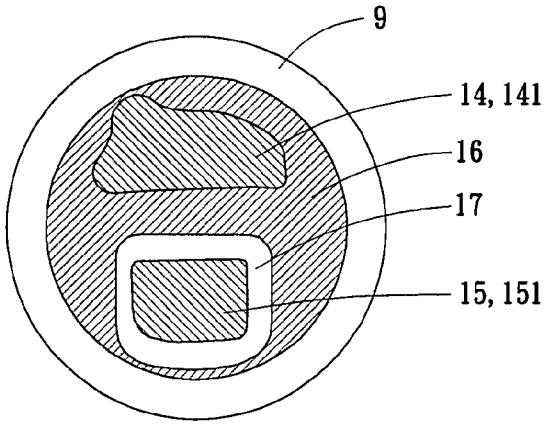
FIG. 4 illustrates a terminal of a microphone with shielding layer attached to a microphone.
Figure 5:
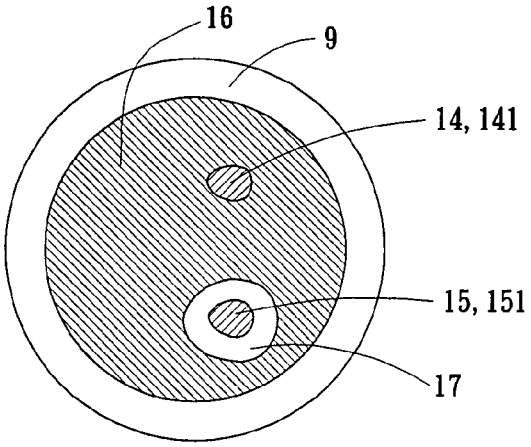
FIG. 5 illustrates a terminal of a microphone with shielding layer attached to a microphone.
Figure 6:
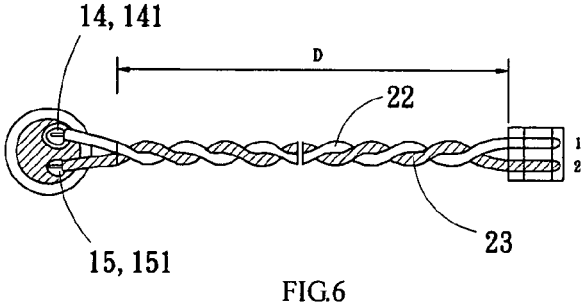
FIG. 6 illustrates a terminal of a microphone with shielding layer connects with an amplifier of a mobile communication device through twisted wrapped conducting wire.

What is claimed is:

1. A microphone comprising:

a printed circuit board;

a negative terminal connected to a first conducting wire and located on said printed circuit board;

a positive terminal connected to a second conducting wire and attaching to said printed circuit board; and a shielding layer formed by an enlarged area of said negative terminal and surrounding said positive terminal with a gap.

2. A microphone of claim 1, wherein said enlarged area of said negative terminal is made of copper foil.

3. A microphone of claim 1, wherein said negative terminal and said positive terminal are separated with said gap.

4. A microphone of claim 1, wherein said negative terminal and said positive terminal are connected to an amplifier through said first conducting wire and said second conducting wire.

5. A microphone of claim 1, further comprising a capacitor and an impedance conversion circuit, wherein said impedance conversion circuit is connected with the signal output of said microphone.

6. A microphone of claim 5, wherein said capacitor is an electret capacitor.

7. A microphone of claim 5, wherein said impedance conversion circuit comprises diodes, a resistor and metal oxide semiconductors.

8. A microphone of claim 5, further comprising an amplifier coupled to said impedance conversion circuit and said signal output.

9. A microphone of claim 1, wherein said microphone is embedded into a mobile communication device.

10. A microphone of claim 9, when said mobile communication device is connected to a charger, the low frequency interference produced by said charger radiates to the surroundings of said mobile communication device and causes interference to said microphone.

11. A microphone of claim 1, wherein said first conducting wire connected with said first electrode is twisted wrapped with said second conducting wire connected with said second electrode to reduce the electromagnetic radiation area, and said shielding layer is used to reduce the electromagnetic interference from outside.

12. A microphone of claim 1, wherein said negative and positive terminal each is attached to said printed circuit board by electroplating or adhering on said printing circuit board.

* * * * *